United States Patent [19]

Underwood

[11] 4,186,452

[45] Feb. 5, 1980

[54] ADJUSTABLE BED SUPPORT PEDESTAL

[76] Inventor: Ronald Underwood, 1415 W. North St., #718, Anaheim, Calif. 92801

[21] Appl. No.: 929,574

[22] Filed: Jul. 31, 1978

[51] Int. Cl.[2] ..... A47C 27/08

[52] U.S. Cl. ..... 5/58; 5/400; 5/474; 5/493

[58] Field of Search ..... 5/58, 317, 349, 365, 5/370, 371; 160/330; 24/201 C, 201 CC

[56] References Cited

U.S. PATENT DOCUMENTS

| | | | |
|---|---|---|---|
| 2,139,980 | 12/1938 | Simon | 5/33 |
| 3,338,284 | 8/1967 | Ausnit | 24/201 C |
| 3,652,373 | 3/1972 | Noble | 160/330 |
| 3,761,974 | 10/1973 | Kuss | 5/370 |
| 4,073,019 | 2/1978 | Fraser | 5/370 |
| 4,107,799 | 8/1978 | Lambert | 5/370 |

OTHER PUBLICATIONS

Industry Mag. May 1978, p. 21, "The Journal for the Waterbed Trade".

*Primary Examiner*—Casmir A. Nunberg
*Attorney, Agent, or Firm*—William F. McDonald

[57] ABSTRACT

The present invention relates to an adjustable bed support pedestal. The pedestal includes at least two longitudinal, substantially vertical planar support members which have a length substantially equal to the length of the bed to be supported. The longitudinal support members are arranged in spaced, parallel relationship with one another within the perimeter of the bed to be supported. Each of the longitudinal support members has at least two vertically extending slots extending partially therethrough in spaced parallel relationship.

The support pedestal includes at least two transverse, substantially vertical planar support members extending outwardly at substantially right angles to a longitudinal support member from an inside end inside the longitudinal support member to an outside end at the perimeter of the bed to be supported. The transverse support members are arranged in spaced, parallel relationship with one another. Each of the transverse support members has a vertically extending slot extending partially therethrough near its inside end, and adapted to intersect with a corresponding slot in the longitudinal support member so that the top surfaces of the transverse and longitudinal support members are coplanar, and the bottom surfaces of the longitudinal and transverse support members are coplanar. A rail assembly is provided extending between the outside edges of the longitudinal and transverse support members beneath the perimeter of the bed to be supported. The rail assembly rests in grooves provided in the support members adjacent the outside ends thereof, so that the top surface of the rail assembly is coplanar with the top surfaces of the longitudinal and transverse support members.

1 Claim, 6 Drawing Figures

ADJUSTABLE BED SUPPORT PEDESTAL

BACKGROUND OF THE INVENTION

The present invention relates to support pedestals for beds. Although not limited thereto, it is particularly applicable to support pedestals for waterbeds.

In recent years, pedestals, rather than conventional bed frames, have come into increasing use to support bed assemblies. The initial impetus for this usage perhaps came from commercial lodgings, such as hotels, motels, and the like, in that the pedestals simplify their operations. However, pedestals have also come into increasing home usage.

Also in recent years the waterbed has been developed. The earlier waterbeds involved an enclosure for the water filled mattress which sat directly on the floor. However, with time, both to reduce the weight of the waterbed and also to raise the water bed to the height of a conventional bed without increasing the weight, it became a practice to put the waterbed assembly on a support pedestal as well as conventional bed assemblies.

One problem that has developed is that a different size support pedestal would have to be utilized for each size bed, double, twin, queen, king, and the like. This greatly increases the cost and inventory requirements for the merchandiser of beds. Also, the owner would have to change pedestals every time a change in bed size was made.

SUMMARY OF THE INVENTION

It is an advantage of the present invention that it provides an adjustable bed support pedestal which can be very simply adjusted to support various size beds, whether water filled or conventional. It is a further advantage of the present invention that although the pedestal is relatively light, in structure and in weight, still it has great strength for its weight, and can support a water filled mattress.

It is a further advantage of the present invention that a decorative valance can be readily secured around the perimeter thereof, thus enhancing the physical appearance of the assembly, conventional pedestals frequently being somewhat unattractive in appearance.

It is a further advantage of the present invention that it provides a support pedestal which can include storage bins therein for additional storage in the room in which the bed pedestal and bed assembly are located.

The present invention relates to an adjustable bed support pedestal. The pedestal includes at least two longitudinal, substantially vertical planar support members which have a length substantially equal to the length of the bed to be supported. The longitudinal support members are arranged in spaced, parallel relationship with one another within the perimeter of the bed to be supported. Each of the longitudinal support members has at least two vertically extending slots, extending partially therethrough in spaced parallel relationship.

The support pedestal includes at least two transverse, substantially vertical planar support members extending outwardly at substantially right angles to a longitudinal support member from an inside end inside the longitudinal support member to an outside end at the perimeter of the bed to be supported. The transverse support members are arranged in spaced, parallel relationship with one another. Each of the transverse support members has a vertically extending slot extending partially therethrough near its inside end, and adapted to intersect with a corresponding slot in the longitudinal support member so that the top surfaces of the transverse and longitudinal support members are coplanar, and the bottom surfaces of the longitudinal and transverse support members are coplanar. A rail assembly is provided extending between the outside edges of the longitudinal and transverse support members beneath the perimeter of the bed to be supported. The rail assembly rests in grooves provided in the support members adjacent the outside ends thereof, so that the top surface of the rail assembly is coplanar with the top surfaces of the longitudinal and transverse support members.

Other objects and advantages of the invention will become apparent from the following description taken in connection with the accompanying drawings wherein like numerals have been used for like parts throughout.

DETAILED DESCRIPTION

Figure 1:
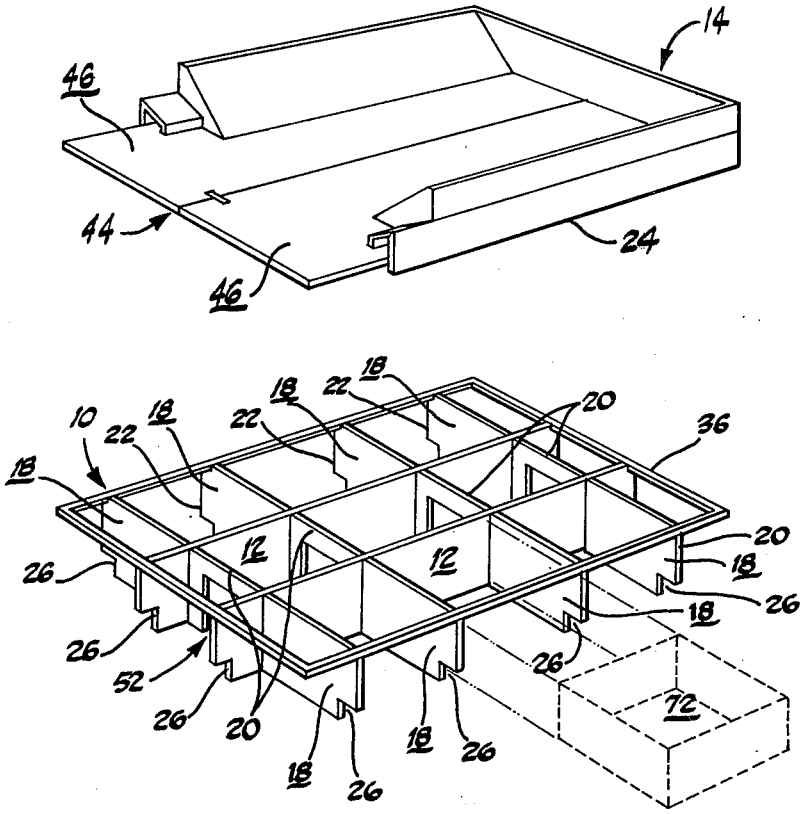
FIG. 1 is a perspective view of a bed support pedestal according to the present invention.
Figure 2:
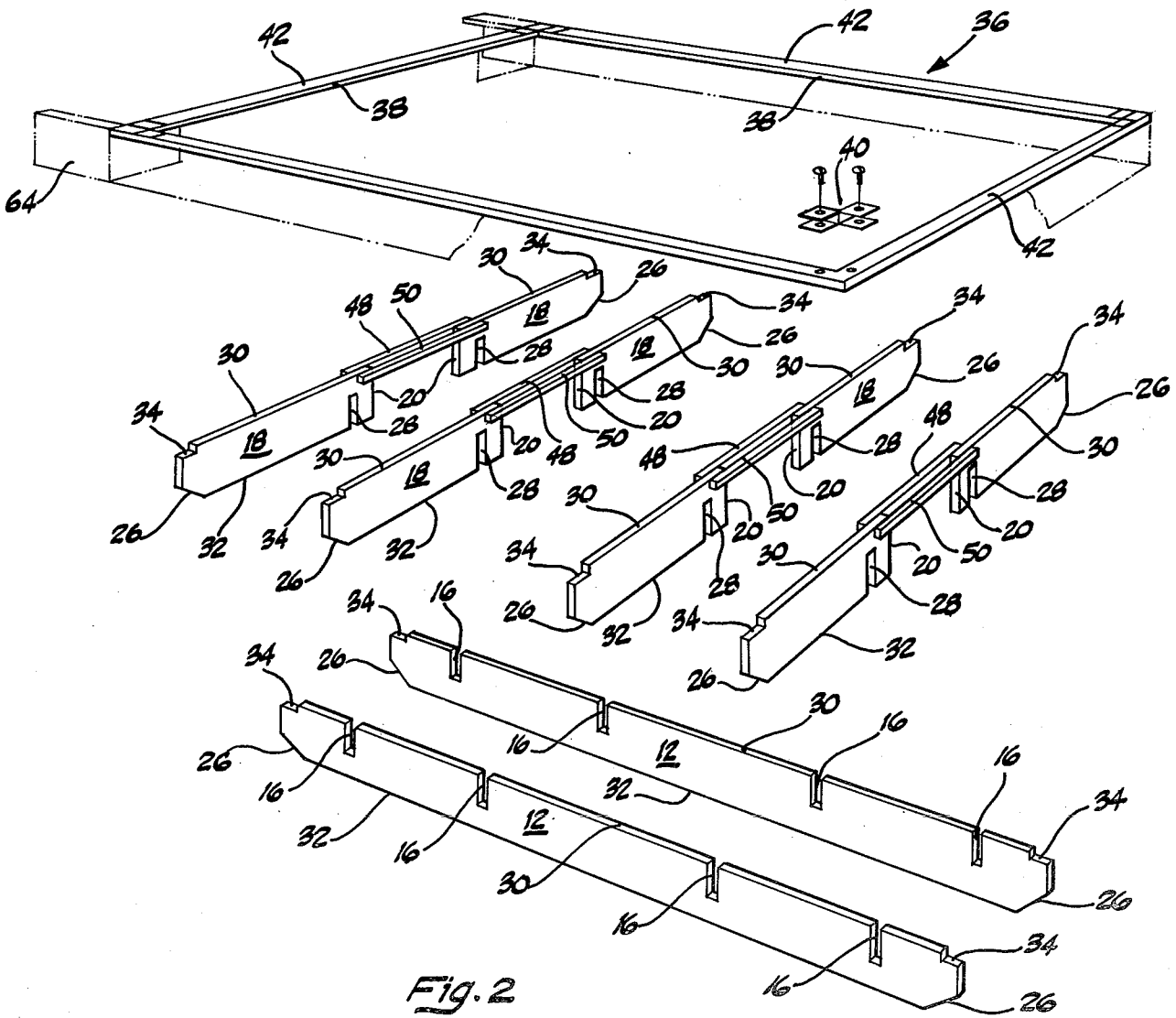
FIG. 2 is an exploded perspective view of an alternate embodiment of the invention.

Referring now to the drawings, particularly FIGS. 1 and 2 wherein like numerals have been used for like parts, the bed support pedestal according to the present invention is indicated generally at 10. In this embodiment, since variation in bed size tends to be by width rather than length, two longitudinal, substantially vertical planar support members are indicated at 12. Longitudinal support members 12 have a length substantially equal to the length of the bed to be supported. As shown, longitudinal support members 12 are arranged in spaced, parallel relationship with one another within the perimeter of the bed, indicated generally at 14, to be supported. Bed 14 may be either conventional or of waterbed type. Each longitudinal support member 12 has at least two vertically extending slots, 16, extending partially therethrough in spaced, parallel relationship. In the embodiment shown, each longitudinal support member 12 has four such vertically extending slots, 16, therein.

The pedestal, 10, also includes at least two, four being shown in FIG. 1 and eight being shown in FIG. 2, transverse, substantially vertical planar or support members, 18. Each transverse support member, made of metal, wood, or other appropriate material, either solid or open, 18, extends outwardly at substantial right angles to a longitudinal support member, 12, from an inside end 20, inside longitudinal support member, 12, to an outside end 22, at the perimeter, 24, of the bed to be supported. Transverse support members, 18, are also arranged in spaced, parallel relationship with one another. As shown, each of the longitudinal support members made of metal, wood, or other appropriate material, either solid or open, 12, and transverse support members, 18, may have a notch, 26, either triangular, or right angle, provided therein to permit anyone making the bed, 14, supported by pedestal, 10, to stand closer to the bed, 14.

Each of the transverse support members, 18, has a vertically extending slot, 28, extending partially therethrough near its inside end, 20, and adapted to intersect with a corresponding slot, 16, in a longitudinal support member, 12, as shown, so that the top surfaces, 30, of the transverse support numbers, 18, and longitudinal support members, 12, are coplanar, and the bottom surfaces, 32, of the longitudinal support members, 12, and transverse support members, 18, are also coplanar. As can be seen, each of the support members, 12, and 18, has a groove, 34, provided therein adjacent the outside ends thereof.

A rail assembly indicated generally at 36, which may be constructed of four perimeter boards, 38, joined at their corners by brackets, 40, the entire rail assembly, 36, being dimensioned to fit into groove, 34, and is positioned so as to extend between the outside edges of the longitudinal support members, 12, and transverse support members, 18, beneath the perimeter 24, of the bed, 14, to be supported. In this position, rail assembly, 36, will rest in grooves, 34. Because of the dimensioning of the grooves, 34, and rail assembly, 36, the top surface, 42, of rail assembly, 36, is coplanar with the top surfaces, 30, of longitudinal support members, 12, and transverse support members, 18. This positioning of rail assembly, 36, in effect, ties together at the outside ends the various longitudinal support members, 12, and transverse support members, 18, resulting in a structurally rigid, light, yet strong, assembly, which can support bed, 14. Since the spacing between longitudinal support members, 12, may be varied, the entire width of pedestal, 10, may be varied in accordance with the width of the bed, 14, to be supported.

In the embodiment shown in FIG. 1, a substantially planar bed support, 44, having a length and width substantially equal to the length and width of the bed, 14, to be supported, is positioned beneath bed, 14, in a generally horizontal position, and upon the top surfaces, 42, 30, of the rail assembly, 36, transverse support members, 18, and longitudinal support members, 12. Such a bed support member is not always necessary, and may not always be used. However, if such a bed support member, 44, is used, which may frequently be the case if a waterbed is being supported, and further if bed support member, 44, is comprised of two sections, 46, as shown, it may be desirable to provide additional support in pedestal, 10, along the intersection of sections, 46. This is shown in the drawings.

The inside end, 20, of a first transverse support member, 18, intersecting one longitudinal support member 12, is in space, opposed, parallel relationship with the inside end, 20, of a second transverse support member, 18, intersecting another longitudinal support member, 12. A bridge member, 48, extends between and is attached to the inside end, 20, of the first and second transverse support members, 18, in any appropriate manner. For example, in FIG. 2, bridge member, 48, is shown as comprising a pair of slats which may be affixed to the sides of transverse support members at the ends thereof, in any well known manner, such as by nails, glue, and the like. In the embodiment shown in FIG. 3, bridge member, 48, comprises a channel piece, which is slipped over and rests upon inside ends, 20, of transverse support members, 18.

The size of bridge member, 48, may be varied with the spacing between the longitudinal support members, 12, permitting width adjustment, based upon the width of the bed, 14, to be supported. The top surface, 50, of bridge member, 48, is coplanar with the top surfaces of the transverse support members, 18, longitudinal support members, 12, and rail assembly, 36.

As is shown, bridge members, 48, have a vertical dimension less than that of the transverse support members, 18, whereby an opening, 52, is provided below bridge member, 48. Opening, 52, will permit the storage of long objects in pedestal, 10, below bed, 14. It will be appreciated that bed support member, 44, will rest upon the top surface, 50, of bridge members, 48, as well as the perimeter rail assembly, 36, longitudinal support members, 12, and transverse support members, 18. Bridge member, 48, provides additional stiffening of the pedestal's assembly and also provides support where needed for the intersection between sections, 46, of bed support member, 44.

Figure 3:
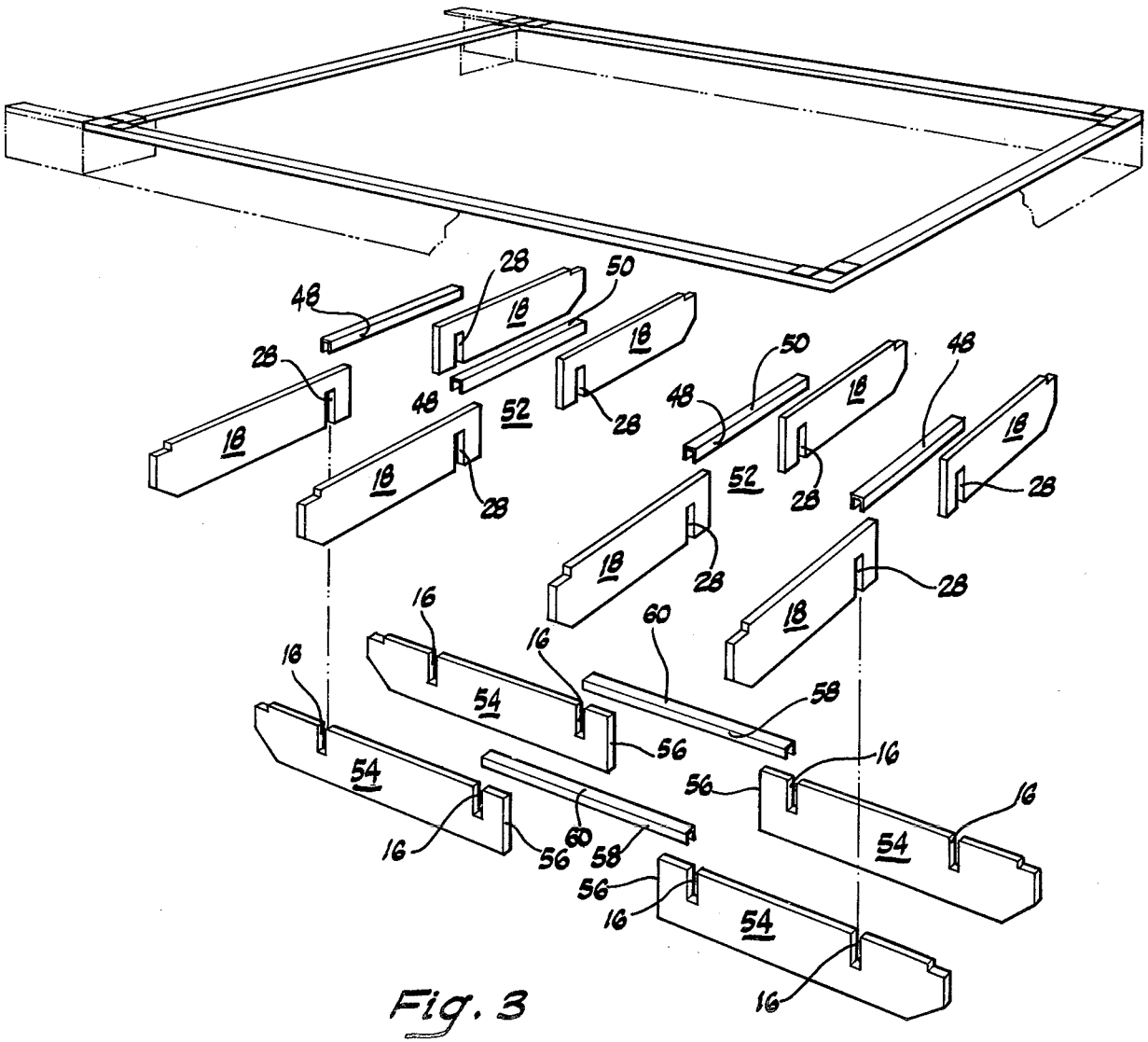
FIG. 3 is an exploded perspective view of another embodiment of the invention.

It may at times be desirable to have a pedestal, 10, which may be adjustable for the change in the length of a bed, 14, as well as the width thereof. A pedestal, 10, according to the present invention, which permits such adjustment is shown in FIG. 3. The embodiment in FIG. 3 can also be used to provide inside storage for long objects as well.

As shown in FIG. 3, at least one, both being shown, longitudinal support member, 12, is composed of two substantially vertical planar members, 54, in spaced parallel end to end relationship with inside end, 56, of one planar member, 54, facing inside end, 56, of the other planar member, 54. A bridge member, 58, whose construction is generally similar to bridge member, 48, extends between and is attached to the facing ends, 56, of planar members, 54, in any appropriate manner, as previously discussed. Again, as is true of bridge members, 48, bridge members, 58, will have top surfaces, 60, which are coplanar with the top surfaces of the transverse support members, 18, longitudinal support members, 12, and rail assembly, 36. Bridge members, 58, have a vertical dimension less than that of planar members, 54, whereby an opening, 62, is provided below bridge members, 58.

Figure 4:
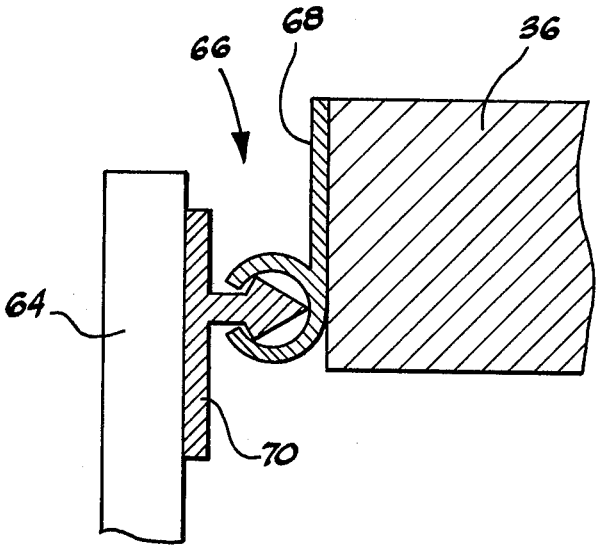
FIG. 4 is a detailed showing of one of the features of the invention.
Figure 5:
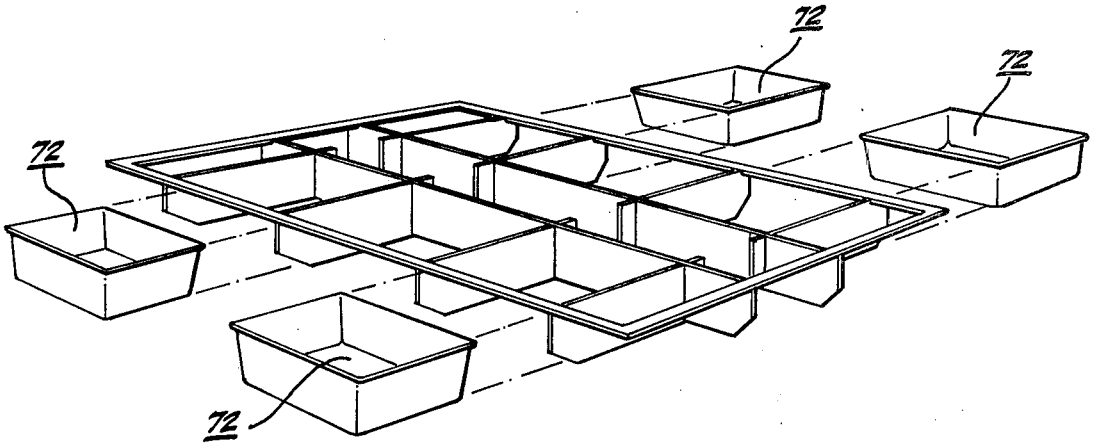
FIG. 5 is a perspective view of another embodiment of the present invention.
Figure 6:
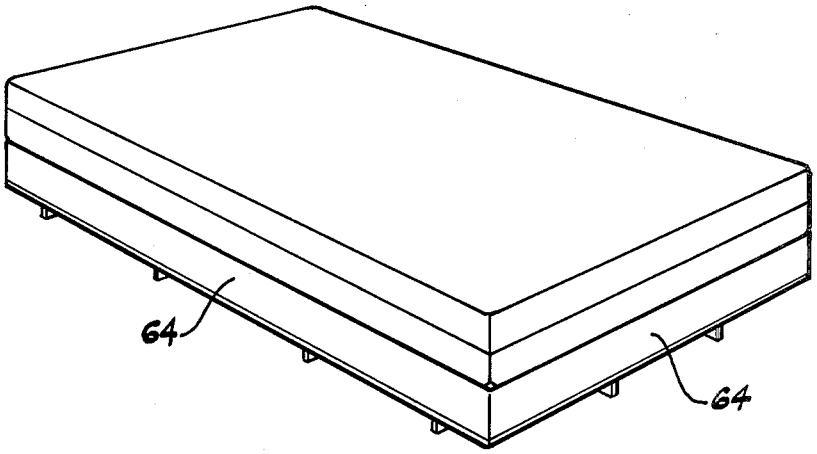
FIG. 6 is a perspective view of a bed in place on a pedestal according to the present invention.

As shown in FIG. 2, means may be attached to the outer perimeter of rail assembly, 36, for securing a valance, 64, thereto. In the embodiment shown in FIG. 6, valance, 64, which amy be of fabric, wood, plastic, or other suitable materials, is shown in place around pedestal, 10. FIG. 2, shows valance, 64, starting to be slid into position around the perimeter of rail assembly, 36. As shown in the detailed view of FIG. 4, the means for attaching valance, 64, to rail assembly, 36, comprises a male/female track assembly, indicated generally at 66, one portion of track assembly, 66, the female portion, 68, being shown, being secured as by nails, adhesive, and other well known means, to the outer perimeter of rail assembly, 36, and the other portion of male/female track assembly, 66, the male portion, 70, being shown, is secured to valance, 64, by any well known means, such as sewing, stapling, and the like. To secure the valance, 64, around rail assembly, 36, one merely has to slide male portion, 70, carrying with it, valance, 64, through female portion, 68, attached to rail assembly, 36, and thus slide the valance, 64 into position. Valance, 64, may extend entirely around the pedestal, 10, or at least the visible portions thereof, if the bed is positioned against a wall. In this way a neat, physically attractive and decorative bed, 14, pedestal, 10, assembly may be achieved. As shown in FIGS. 1 and 5, one or more, if desired, storage bins, 72, may be slidably disposed in the space between support members, either transverse support members, 18, or longitudinal support members, 12, or any combination thereof. Storage bin, 72, may be slidably disposed by any well known means, including simply being adapted to slide along the surface of the floor or ground upon which pedestal, 10, rests.

It will be appreciated that the foregoing is only a description of certain embodiments of the present invention. This is for illustrative purposes, and the present invention is not to be limited thereby, but only by the claims.

I claim:

1. An adjustable bed support pedestal which comprises:

(a) At least two longitudinal substantially vertical planar support members having a length substantially equal to the length of the bed to be supported and arranged in spaced, parallel relationship with one another within the perimeter of the bed to be supported, each of the longitudinal support members having at least two vertically extending slots extending partially therethrough in spaced parallel relationship wherein at least one longitudinal support member is composed of: Two substantially vertical, planar members in spaced, parallel, end to end relationship with one end of one facing one end of the other; and a bridge member extending between and attached to the facing ends of the planar members and having a top surface co-planar with the top surface of transverse support members, longitudinal support members, and a rail assembly, and having a vertical dimension less than that of the planar members, whereby an opening is provided below the bridge member;

(b) At least two transverse, substantially vertical planar support members extending outwardly at substantially right angles to a longitudinal support member from an inside end inside the longitudinal support member to an outside end at the perimeter of the bed to be supported and arranged in spaced parallel relationship with one another, each of the transverse support members having a vertically extending slot extending partially therethrough near its inside end and adapted to intersect with a corresponding slot in the longitudinal support member so that the top surfaces of the transverse and longitudinal support members are co-planar and the bottom surfaces of the longitudinal and transverse support members are co-planar wherein the inside end of a first transverse support member intersecting one longitudinal support member is in spaced, opposed, parallel relationship with the inside end of a second transverse longitudinal support member and including as an additional element a bridge member extending between and attached to the inside ends of the first and second transverse support members and having a top surface co-planar with the top surfaces of the transverse support members, longitudinal support members, and a rail assembly, and having a vertical dimension less than that of the transverse support members, whereby an opening is provided below the bridge member;

(c) A rail assembly extending between the outside edges of the longitudinal and transverse support members beneath the perimeter of the bed to be supported and resting in grooves provided in the support members adjacent the outside ends thereof so that the top surface of the rail assembly is co-planar with the top surfaces of the longitudinal and transverse support members;

(d) Means attached to the outer perimeter of the rail assembly for securing a valance thereto, which comprises one portion of a male-female track assembly, the other portion of the assembly being attached to the valance, and wherein the valance securing means comprises the female portion of the male-female track assembly;

(e) A substantially planar bed support member having a length and width substantially equal to the length and width of the bed to be supported and adapted to be positioned beneath the bed in a generally horizontal position and upon the top surfaces of the transverse support members, the longitudinal support members, and the rail assembly; and (f) A storage bin slidably disposed between support members and beneath the rail assembly.

* * * * *